United States Patent [19]

Sage et al.

[11] 3,999,610

[45] Dec. 28, 1976

[54] PIPE SNUBBING METHOD AND APPARATUS

[75] Inventors: Vernon R. Sage, Carrollton; Phillip S. Sizer, Dallas, both of Tex.

[73] Assignee: Otis Engineering Corporation, Dallas, Tex.

[22] Filed: Oct. 8, 1975

[21] Appl. No.: 620,637

Related U.S. Application Data

[63] Continuation of Ser. No. 525,858, Nov. 21, 1974, abandoned.

[52] U.S. Cl. ..... 166/315; 166/77; 175/162; 175/203; 226/150; 226/159; 226/162

[51] Int. Cl.[2] ..... E21B 19/00; E21B 19/08

[58] Field of Search ..... 166/77, 315; 254/29 R, 254/30, 31, 93 R; 175/162, 203; 226/150, 162, 159, 1

[56] References Cited

UNITED STATES PATENTS

| | | | |
|---|---|---|---|
| 1,894,912 | 1/1933 | Otis | 166/315 |
| 2,126,933 | 8/1938 | Stone et al. | 166/77 |
| 2,555,145 | 5/1951 | McKinney | 166/77 |
| 3,096,075 | 7/1963 | Brown | 254/29 R |
| 3,215,203 | 11/1965 | Sizer | 166/77 |
| 3,329,327 | 7/1967 | Scribner | 226/162 X |
| 3,602,413 | 8/1971 | Montesson et al. | 226/162 X |
| 3,797,570 | 3/1974 | Leutwyler | 166/77 |

*Primary Examiner*—Stephen J. Novosad
*Attorney, Agent, or Firm*—Vinson, Elkins, Searls, Connally & Smith

[57] ABSTRACT

A pipe snubbing apparatus and method which may utilize either the draw works of a conventional rig or a pump to provide power for raising the movable gripping assembly.

The movable gripper is moved downwardly by stored power, such as pressure stored in an accumulator. The rate of movement of the movable gripping assembly may be controlled by controlling flow of fluid to and from a piston and cylinder assembly associated with the movable gripping assembly.

22 Claims, 6 Drawing Figures

PIPE SNUBBING METHOD AND APPARATUS

This Application is a continuation of application Ser. No. 525,858, filed Nov. 21, 1974, for Pipe Snubbing Apparatus and Method, now abandoned.

This invention relates to apparatus and method for snubbing pipe. In many instances it is necessary to run or pull tubing from a well under pressure so that treating or loading fluids may be circulated through the well bore for the purpose of treating or killing the well. When the conditions of the well are such that the tubing is "light", it must be forced into the well when running pipe and prevented from being projected out of the well when pulling pipe. Apparatus for carrying out this function is disclosed in Otis U.S. Pat. No. 1,894,912 and Sizer U.S. Pat. No. 3,215,203. The disclosure of these patents are incorporated herein by reference, the former utilizing a conventional draw works and the latter utilizing a pump system. This invention is an improvement in the field and has several advantages over these two patents. For instance, in the Otis Patent which utilizes a draw works, the operator of the draw works is faced with abnormal or reverse operations. Usually, when the cable is taken in, pipe is pulled from the well. In the Otis case, when the cable is taken in, pipe is pushed into the well. This unorthodox operation has a potential danger in that it is backwards from ordinary operations. In ordinary operations, the brake is used to permit the pipe to gravitate into the well rather than to allow it to move upwardly out of the well and the draw works is used to lift the tubing out of the well rather than to force it into the well. Under these circumstances, human error is a potential danger. Improper operation of the apparatus may quickly result in disaster. Also, the Otis operation is quite slow. Not only must the traveling block 27 travel twice as far as the pipe in stuffing pipe, but the traveling clamp 26 must be lifted in some manner on each return stroke. In the event of failure or malfunction of the power source, such as breaking of the cable, under pipe-light conditions the pipe becomes a projectile and is driven upwardly by the pressure in the well.

In the case of the Sizer Patent, a separate source of power is required, which is undesirable as the great majority of either drilling rigs or workover rigs will have a draw works available. As in the case of the Otis Patent, the operation is relatively slow due to the time required to pump fluids. Also as in the case of Otis, if a malfunction occurs, the pipe may become a projectile under pipe-light conditions.

It is an object of this invention to provide a snubbing apparatus and method which in the event of failure or malfunction of the power source moves in a direction to snub pipe into a well.

Where conventional rigs are used, gravity is relied upon to move the traveling block downwardly in the derrick and thus much time is lost because of the slow descent of the traveling block. Another object of this invention, therefore, is to provide apparatus and method which will accelerate the downward travel of the block in the derrick.

When a conventional rig is used for snubbing pipe into or out of a well, releasing of the brake will generally permit the pipe to move upwardly out of the well. Another object of this invention is to provide apparatus and method which, when the brake is released, will cause or permit the pipe to move down and into the well. Thus, the apparatus is fail safe in this respect.

Another object of this invention is to provide a snubbing apparatus and method which may utilize a conventional draw works and in which the relationship of operation of the draw works to pipe movement is conventional; that is, pipe is raised as the cable is taken in, thus, eliminating the possibility of operator error present when the relationship between draw works and pipe movement are reversed.

Another object is to provide a snubbing apparatus and method utilizing a conventional draw works system such as carried by a workover rig to indirectly supply power for snubbing, in which cable and pipe movement are in conventional directions and in which failure of the draw works system and method results in snubbing pipe into the well.

Another object is to provide a snubbing system and method in which pipe is snubbed at a controlled rate to prevent damage if the system malfunctions or is operated improperly.

Another object is to provide a snubbing system which may be left on the rig during normal running or pulling of pipe.

Another object is to provide a snubbing system and method which may employ conventional draw works such as utilized on a workover rig to provide power for travel of the movable pipe gripper in both directions without re-rigging.

Another object is to provide a snubbing system and method which may employ a conventional draw works such as utilized on a workover rig to provide power for travel of the movable pipe gripper in which movement of the cable and movable pipe gripper are at a one to one ratio.

Another object is to provide a snubbing system and method which has a higher speed of operation than possible in the past.

Another object is to provide a snubbing apparatus and method which utilizes draw works for motive power and in which the movable pipe gripping system is moved under power in both directions.

Another object is to provide a pipe snubbing apparatus and method in which the movable pipe gripping may move freely in one direction while the movement in the opposite direction is closely controlled.

Other objects, features and advantages will be apparent from the drawings, specification and claims.

In the drawings where an illustrative embodiment of this invention are shown and wherein like numerals indicate like parts:

Figure 1:
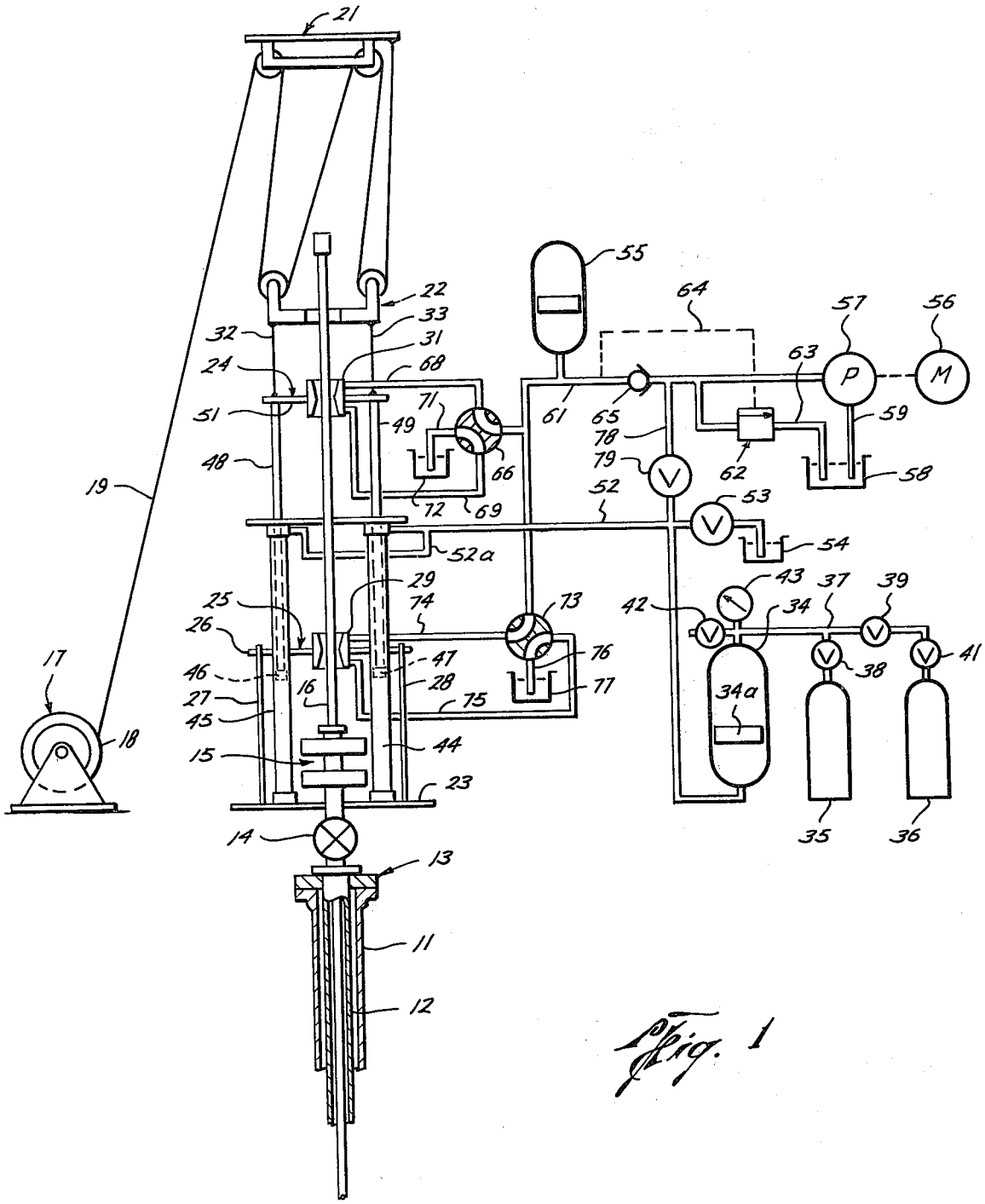
FIG. 1 is a schematic view showing snubbing apparatus embodying this invention installed on a well and being used in conjunction with a conventional rig.

Referring first to FIG. 1, the invention is illustrated in conjunction with a well have a casing 11 with a tubing 12 therein. The casing head is indicated generally at 13 and will include the customary structure with its numerous valves and connections providing for flow and circulation of fluid. Above the master valve 14, the blowout preventor assembly 15 is positioned for sealing about a pipe 16 which is shown being run into the well.

The system in FIG. 1 is shown in conjunction with a conventional rig such as a workover rig which will include a conventional draw works 17. The reel 18 of the draw works will have spooled thereon the cable 19. The draw works will also include the conventional clutch and brake assembly as well as a suitable source of power to provide for spooling of the line 19 under power and for clutching the draw works relative to the power source to disconnect the power source and for braking the reel to control unspooling of the line 19.

The line 19 is trained over sheaves of the crown block indicated generally at 21 and the traveling block indicated generally at 22. The draw works 17 is operated in the customary manner to raise and lower the traveling block 22.

Apparatus constructed in accordance with this invention is associated with the conventional wellhead assembly and rig assembly as shown. Preferably, the apparatus is supported by securing it to a platform 23 which may be secured to the wellhead as shown, or, which may be secured to the ground. In either event, the base of the apparatus is held against vertical movement.

The snubbing apparatus includes a movable means indicated generally at 24 and a holding means, indicated generally at 25, which are mounted for relative movement toward and away from each other. The holding means 25 is supported on a cross-member 26, which in turn is supported on standards 27 and 28. The holding means may take any desired form which will grip the pipe and hold the pipe against vertical movement while the movable means 24 is moving into a new position.

The movable means 24 may also take any desired form which will grip the pipe to move the pipe into or out of the well with movement of the movable means 24.

A gripping means 29 is provided on the holding means 25 and another gripping means 31 is provided on the movable means 24. These gripping means may be conventional in form and are designed to alternately grip the pipe 16 which is being snubbed into or out of the well.

The cable 19 and its associated draw works and prime mover, provide the power means for moving the movable means 24 in one direction. In the form illustrated in FIG. 1, this movement is upwardly of the drawings. It will be appreciated that with such movement, the operator is using power to move the traveling block 22 in an upward direction, which is the normal, conventional method of operation of a draw works and traveling block. Thus, he will use his clutch and brakes in the normal manner instead of in a reverse manner as shown in the above identified Otis Patent and errors of judgement and operation which might be induced by a reverse operation of these parts are eliminated.

From the above, it will be apparent that the operation of the draw works 18 will reel in the line 19, raising the traveling block 22 and the movable means 24, which is secured to the traveling block by a pair of rods, or cables, 32 and 33. At the upper end of the stroke, the power means is rendered ineffective by declutching the reel 18 from the prime mover and the system is in condition for the downstroke.

In order to move the tubing 16 downwardly, a source of gas under pressure is provided. This source of gas may take any desired form and is illustrated in the drawings to be provided by an accumulator vessel 34 with a pair of bottles 35 and 36, each of which contain gas under high pressure and a manifold 37 connected to each of bottles 35 and 36 through valves 38, 39, and 41. The manifold 37 is also connected to the accumulator 34 and a suitable vent valve 42 and pressure gauge 43 are associated therewith.

In accordance with the invention, means responsive to the gas under pressure in the accumulator 34 is provided to move the movable means 24 in the down direction after the power means has been disconnected, or rendered ineffective. In the preferred form, the means for transmitting power from the accumulator 34 to the movable member 24 is provided by a system of associated cylinders and pistons attached to the movable means 24 and having a fluid connection with the source of pressure 34.

Preferably, at least two cylinders 44 and 45 are carried by the platform 23. Sealingly reciprocating within these cylinders, are pistons 46 and 47. The pistons 46 and 47 are carried respectively by connecting rods 48 and 49, which are in turn secured to the cross-bar 51 of the movable means 24.

A fluid connection is provided between the accumulator 34 and the side of pistons 46 and 47, adjacent the movable means 24. This connection may be provided by line 52, which is connected to cylinder 44 and a branch line **52*a*, which is connected to cylinder 45. Thus, after the power means is disconnected, the force exerted by the fluid within the accumulator 34 is effective on the upper side of pistons 46 and 47 to drive these pistons downwardly within cylinders 44 and 45 taking with them the movable means 24 to snub the pipe 16** into the well.

In the form of invention shown in FIG. 1, a gas charge is provided in the accumulator 34 above piston **34*a* therein. Below 34*a*, and all through the conduit 52 and 52*a* and the cylinder above the pistons, is preferably filled with liquid. This liquid is charged into the system during its initial assembly. If desired, provision may be made for venting liquid from the system through valve 53 into receptacle 54** and also provision may be made for recharging the system with liquid, as will be explained hereinbelow.

Preferably, the pipe gripping means is automatically controlled, so that they may quickly engage and disengage the pipe 16. For this purpose, an accumulator 55 is provided with a charge of gas under pressure, which provides motive power to operate the gripping means 29 and 31. While the gas charge within accumulator 55 provides the power, it is preferred that the entire system be charged with liquid and that the gas within the accumulator 55 be held under pressure by maintaining the pressure of liquid within the system.

For the above purpose, a suitable motor 56 drives pump 57, which receives fluid from sump 58 through line 59. The pump 57 pressurizes manifold line 61 by operating the pump 57 continuously and providing a bypass control indicated generally at 62, which returns fluid through line 63 to the sump 58 when pressure in line 61 is at adequate level, as indicated through the sensing line 64. A suitable back check 65 prevents loss of pressure from the manifold line 61 downstream of the check 65.

Control of the gripping system 31 is provided by valve 66. The gripping slips within the gripping means 31 are power-operated to gripping and non-gripping position. For instance, with the valve 66 in the position shown, fluid may be conveyed from the manifold 61 through line 68 to one side of a piston (not shown) to set the slips within the gripper 31. At the same time the other side of the piston will be vented through line 69, valve 66 and line 71 to sump 72. Then when it is desired to release the pipe, the valve 66 is rotated to apply pressure from line 61 through line 69 and to vent the system through line 68 to thus reverse pressure across the piston and move the slips into disengaged position.

A similar system is provided for the gripper 29. Valve 73 controls flow through lines 74, 75 and 76 to connect opposite sides of a piston in the gripper 29 with the manifold line 61 and the sump line 76 in alternative manner, as explained above.

If desired, a means may be provided for charging the line 52 of the power return system with liquid from the pump 57. For this purpose, a line 78 connects the manifold line 61 with the power line 52 and a suitable valve 79 in such line controls charging of liquid by pump 57 into line 52.

In operation of the system shown in FIG. 1, a pipe 16 will be introduced into the blowout preventer stack 15 above the master valve 14 and the gripping means 29 will be activated to hold the pipe in position and the master valve 14 opened to provide access to the well.

Pressure within the accumulator 34 will be effective to move the two pistons 46 and 47 to their full down position. At this time, the draw works 17 is activated to reel in line 19 and lift the movable means 24 against the force of the pressure within the accumulator 34 to the full upper position. At this time, the valve 66 will be activated to move the gripping means 31 into gripping position and the valve 73 will be activated to release the gripping means 29. The clutch on the draw works will be disengaged to release line 19 and the force of pressure within the accumulator 34 being effective on the upper side of pistons 46 and 47, will move these pistons downwardly, carrying with them the movable means 24. Downward movement will be controlled by the brakes on the draw works. When the movable means 24 reaches the bottom of its stroke, the gripping means 29 will be engaged to hold the tubing 16 in position and a new cycle will commence. It will be appreciated that each time that the draw works reels in line 19 to raise the pistons 46 and 47, working pressure is stored in the accumulator 34 to be available for pushing the pipe 16 downwardly on the next stroke.

As soon as the pipe is no longer in a pipe-light condition and the amount of pipe within the well exerts a greater downward force due to its weight than the pressure tending to blow the pipe from the well the above described operation may be discontinued and the traveling block may be utilized to lower pipe into the well in the conventional manner. Either conventional supporting slips may be used in this operation, or if desired, the fixed gripping means 29 may be utilized during this operation.

After carrying out the desired operations in the well, the pipe 16 may be withdrawn. It will be withdrawn in the conventional manner until such time as a pipe-light condition is approached. Than at this time, the system of this invention will again be utilized, but this time, it will utilize the power of the draw works to snub the pipe 16 out of the hole by overcoming the force exerted by pressure in the accumulator 34. The accumulator 34 will be charged to a pressure which will hold the pistons in their down condition against the pressure within the well tending to project the pipe 16 therefrom. Of course, the pressure within the accumulator 34 may be varied either during snubbing the pipe in or out of the hole so that the force exerted by the fluid within the accumulator will be just greater than that necessary to carry out the operation.

As the pipe becomes light, the force of pressure within accumulator 34 is effective to prevent upward movement of the pipe due to pressure within the well. With the traveling means 24 in its lower position, the gripping means 31 thereof is engaged and the draw works 17 used to pull the pipe from the well by raising the movable means 24 against the accumulator 34. Then, the gripping system 29 is activated and the gripping system 31 deactivated. The movable member 24 is then lowered due to the pressure within the accumulator 34 and control of its downward movement is effected by utilizing the brakes of the draw works to control reeling out of line 19.

It will be appreciated that both during snubbing in and snubbing out, that the pressure within the accumulator exerts a force which is greater than the force within the well tending to eject the pipe 16 therefrom. Thus, if there is any malfunction, in the lifting system, the apparatus will fail safe in a direction to urge the pipe back into the hole. This prevents the pipe from becoming a projectile in the event of a failure in the power system when in a pipe-light condition. It is very unlikely that a sudden and complete failure would occur involving both cylinders in the liquid system responsive to the force in the accumulator 34. If anything did happen, the resistance of the fluid in each of the cylinders to rapid movement would provide a dashpot action and limit the velocity of the pipe 16 in an upward direction.

The pressure in the accumulator acting upon the upper sides of the pistons in the cylinders moves the pistons downwardly hastily, much faster than gravity could do so and this pressure is immediately available so that there is no delay in waiting for pressure to build as would be the case in installations utilizing a hydraulic pump for such power.

Thus, it can be seen that much time is saved with apparatus such as that just described since little time is wasted in moving the gripping means to position for taking another stroke.

At the time that the apparatus of FIG. 1 is installed, the hydraulic system for operating the cylinders should be charged with pressure.

Before operations are begun, the valve 39 between the two bottles 35 and 36 is closed and valve 38 at the top of bottle 35 is open, as would be any other such valves on any other such bottles between the valve 39 and the accumulator 34. Also, the valve 53 in the drain conduit is closed. The motor 56 is used to drive the pump 57 to pick up hydraulic fluid from the tank 58 through its suction tube 59 and discharge it into the hydraulic conduit 61 where it pressurizes the circuit for operating both gripping means 29 and 31 and the accumulator 55. The valve 79 in the branch circuit 78 is opened to admit hydraulic fluid into the conduit 52 so that this fluid pressure pressurizes the cylinders 44 and 45 to move the pistons 46 and 47 downwardly therein to their lowermost position. This pressure fluid also enters the lower end of the accumulator 34. The pump 57 continues to force fluid into the conduit 52 until the fluid level in the accumulator rises to the desired level which would assure sufficient fluid for the operation to be performed, after which the valve 79 is closed to divorce or isolate the cylinder circuit from the gripping means circuit.

The valve 41 at the upper end of the bottom or tank 36 is now opened as is the valve 39 in the conduit 37. The gas from bottle 36 flows through the valve 41 into the circuit 37 and into the accumulator 34 as well as into the bottle 35. As soon as the pressure in the accumulator 34 reaches the desired value, the value 39 is closed and should remain closed as long as the pressure indicated by the gauge 43 is at a satisfactory value.

It is readily understood that, when snubbing pipe into the well, as the pipe string grows in length and becomes heavier, less force will be required to move it into the well and, for this reason, as more pipe is added to the pipe string and run into the well the pressure in the accumulator 34 can be reduced by bleeding some gas from the accumulator through valve 42. In a similar manner when pulling pipe from the well as the pipe string becomes shorter and lighter, more pressure in the accumulator 34 will be required. This pressure can be increased as required by opening valves 41 and 39 to permit gas to flow from bottle 36 into the accumulator.

To reduce the pressure in the accumulator 34 in, perhaps, an economical way, the valve 39 in the conduit 37 and the valve 41 at the upper end of bottle 36 can be opened, after which the valve 79 in the branch conduit 78 is opened and the pump 57 is utilized to pump fluid into the lower end of the accumulator thus displacing gas into the bottles 35 and 36. When sufficient fluid has been pumped into the accumulator, the valve 41 as well as the valve 39 may be closed and a portion of the fluid in the accumulator bled back into the tank, thus reducing the gas pressure in the accumulator.

It is understood that when the accumulator is charged or discharged in this manner that the overload dump valve 62 may need to be adjusted to a different pressure, since the pressure normally required to operate the gripping means may be greater or lesser than the pressure required to charge or discharge the accumulator.

It should be readily seen that a new apparatus has been provided for running pipe into or out of a well under pressure and that the apparatus includes accumulator means arranged in such manner that the energy stored therein acts downwardly on pistons in cylinders to move a pipe string downwardly into a well against the well pressure and that a draw works is used to lift the piston rods and the gripping means carried thereby for another stroke. Thus, the draw works or hoisting means is operated in a conventional manner rather than in an unorthodox or unconventional manner. That is to say, that when the draw works is operated to take in on the cable, the traveling block attached to the piston rods is lifted together with the pipe. And, when the cable is allowed to reel out, the traveling block and the pipe are lowred. In this arrangement, the operation is so natural that an operator is not likely to make a mistake and let the pipe blow out of the well. In fact, if the operator allows the brake to slip accidentally, the pipe will move downwardly and into the well rather than blow out.

It has further been shown that when the pipe is being moved upwardly and out of the well that the traveling blocks do not depend on gravity alone to move them downwardly for another stroke but that the energy stored in the accumulator acts instantly downwardly against the pistons to pull the traveling block downwardly, thus saving time. It might be added that this arrangement is more responsive and quicker in action that it would be were it operated strictly by hydraulic means in a conventional manner, since the energy stored in the accumulator is ever ready and instantly available.

Figure 2:
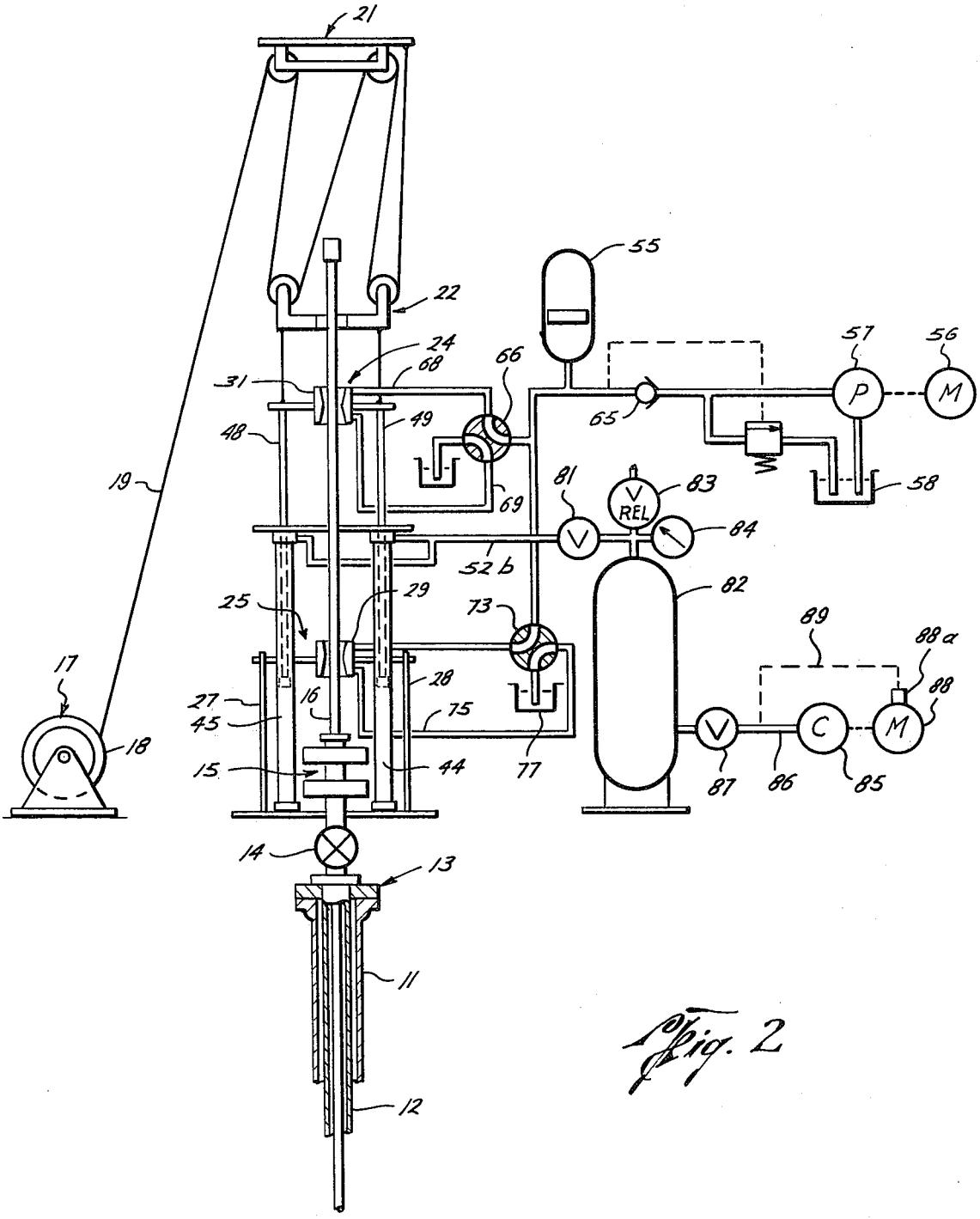
FIG. 2 is a view similar to FIG. 1 illustrating a modified form of this invention.

Referring now to FIG. 2, it will be seen that the same pipe handling equipment illustrated in FIG. 1 can be modified so that the piston cylinder assemblies can be powered by air rather than oil pressure while the pipe gripping means are still operated by the same hydraulic means as was used before. In FIG. 2, the hydraulic circuit is completely separate from the air circuit. In this view, the motor 88 drives the compressor 85 which compresses air and discharges it by way of conduit 86 into the air tank 82 where the air is stored at a suitable pressure until needed. The air tank 82 communicates with the upper end of the cylinders 44 and 45 through the air conduit **52*b*. The pressure of the air in tank 82 always biases the pistons 46 and 47 in the cylinders downwardly to pull the piston rods 48 and 49 downwardly as before explained so that the traveling gripping means 31 will be moved toward the stationary gripping means 29 so that the pipe string 16** is moved into or out of the well as desired and in the manner before explained.

Near the upper end of the air tank 82, the conduit **52*b* has a pressure gauge 84 connected therein to indicate at all times the pressure in the air tank. A relief valve 83 is connected into the conduit 52*b*** at the upper end of the air tank for the purpose of bleeding pressure from the air system as may be required.

The motor 88 is provided with a pressure switch **88*a* which, through the pilot line 89 communicates with and is responsive to the pressure in the tank 82. The pilot line may be connected into the conduit 86 between the compressor and the tank as shown. Thus, when the motor is switched on, the compressor will be driven until the air pressure in the tank reaches sufficient value to activate the pressure switch 88*a* turning the motor off so that the pressure will not go any higher. Should pressure in the tank be reduced, as through usage of the pressurized air, to a predetermined level, the pressure switch 88*a* will cause the motor to switch on the operate the compressor until the pressure in the air tank again reaches sufficient value to actuate the pressure switch 88*a*** and switch the motor off.

The relief valve 82 is a safety valve which will open automatically to bleed pressure off the system should the pressure get dangerously high, i.e., rise above a predetermined value. If desired, a bleeder valve may be placed anywhere in the air system, as between the tank 82 and the pressure gauge 84 to permit air to be bled from the system as desired and especially preparatory to moving the apparatus from one installation to another, or for the purpose of utilizing air for other useful purposes such as powering air driven tools, wrenches, etc.

If desired, a valve 87 may be provided in the conduit 86 between the air tank and the point where the pilot conduit 89 is connected to the conduit 86 and, likewise, a valve 81 may be provided near the upper end of the tank in the conduit **52*b*. The valves 87 and 81 may then be closed to isolate the air pressure in the tank 82** if desired.

It should be understood that in the apparatus 56 of FIG. 1 or in the apparatus 88 of FIG. 2, the motor may be any desired motive force such as an electric motor, internal combustion engine, or the like.

Since, in the apparatus shown in FIGS. 1 and 2, the energy stored in the accumulator or in the air tank is allowed to act on the upper sides of the pistons in the cylinders biasing them downwardly so that the pipe may be snubbed against pressure in the well, the downward movement of the pipe is controlled by the brake of the draw works. The brake lining, therefore, is subject to much wear. Because of this, it may be desirable to control the downward movement of the pipe as by placing a restriction in the fluid conduit connected into the upper ends of the cylinders. It may be further desirable to eliminate the restriction upon moving the pistons in an upward direction. In a similar manner, when pipe is being snubbed out of the well, it may be desirable to have a restriction in the circuit when the pipe is moved upwardly and yet eliminate this restriction when the piston is moved downwardly.

Figure 3:
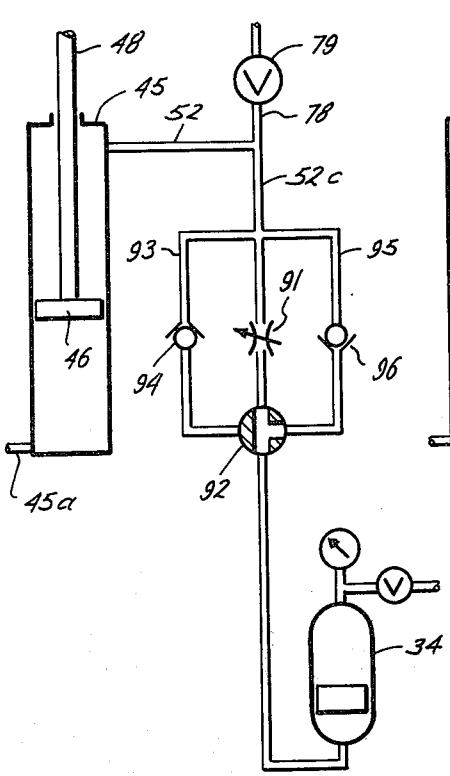
FIG. 3 is a diagrammatic view of one form of fluid circuit control.

Such an arrangement is shown in FIG. 3. In this view only one cylinder and the necessary hydraulic circuitry is shown in schematic form. While a hydraulic circuit is shown, a pneumatic circuit could have been shown as well. For snubbing the pipe out of the well, a three-way valve 92 is positioned as shown so that hydraulic fluids from the accumulator 34 may pass freely through the valve 92 and past the check valve 96 in the branch conduit 95 and into the upper end of the cylinder where it acts downwardly upon the upper side of the piston 46 to move the piston down with haste without depending on gravity to slowly move the traveling blocks and the traveling gripping means down. After the piston has reached its lower position, the pipe is moved upwardly by activating the draw works. As the fluid above the piston in the cylinder moves back toward the accumulator 34 it cannot flow through the check valve 96 but must pass through the adjustable orifice or restriction 91 and through the valve 92 to the accumulator. The restriction 91 can be adjusted until the pipe moves at a desired rate of speed.

Oppositely but similarly, when it is desired to snub pipe into the well, the valve 92 is moved to a different position, that is, its plug is rotated 180°. With the valve in such position, fluid may pass from the accumulator 34 through the valve 92 and through the restriction 91 into the cylinder above the piston 46 and, since this fluid passes through the restriction 91, the pipe will move downwardly only as fast as the restricted fluid flow will permit. The restriction, of course, is adjustable so that the descent of the piston may be controlled to a fine degree. When the piston is then moved upwardly for another stroke, the fluid will pass through the check valve 94 in the branch conduit 93 and through the valve 92 to return to the accumulator 34. It should be understood that fluid may pass through the restriction in either direction.

Figure 4:
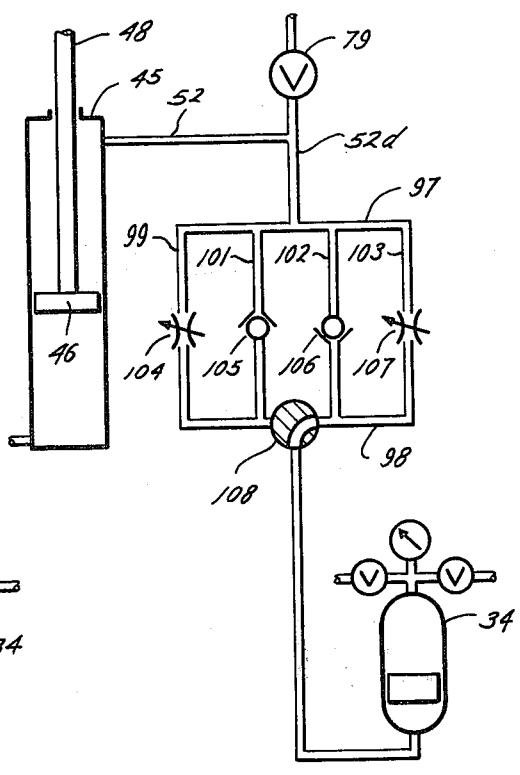
FIG. 4 is a diagrammatic view similar to that of FIG. 3, but showing an alternate circuit control.

In some cases it may be desirable to provide two adjustable restrictions in the circuit so that the ascent and descent of the piston in the cylinder may be controlled independently at different rates. Such an arrangement is shown in FIG. 4. In this case, two check valves and two restrictions are provided.

When snubbing pipe out of the well, the three-way valve 108 is positioned as shown so that fluid may flow freely from the accumulator 34 through the conduit 52, the valve 108, and past the check valve 106 as well as through the adjustable restriction 107 into the cylinder 45 above the piston 46. This does not impede downward movement of the piston. Then, as the pipe is moved upwardly out of the well, fluid from the upper end of the cylinder flows back toward the accumulator and must pass through the restriction 107 only since the check valve 107 will now be closed. The restriction 107 is adjusted until the pipe moves upwardly at the desired rate of speed.

When snubbing pipe into the well, the two-way valve 108 will be rotated 90° so that fluid may flow from the accumulator 34 to the conduit 52, passing through the two-way valve 108, and through the adjustable restriction 104 to the upper end of the cylinder to move the piston downwardly. The restriction 104 is adjusted until the piston moves downwardly at the desired rate of speed. As the piston moves upwardly, the check valve 105 will open permitting fluid to flow through it as well as through the restriction 104.

With such an arrangement as shown in FIG. 4, the valve 108 is placed in one position for snubbing pipe into the well and placed in another position for snubbing pipe out of the well, and in each position the speed of the pipe will be controlled by the preadjusted orifice.

Thus, in the apparatuses of FIGS. 3 and 4, the speed of movement of the pipe when going into or out of the well can be controlled by adjusting an adjustable orifice in the hydraulic circuitry. If it is only desired to control the descent of the pipe, it can be done in another way.

Figure 5:
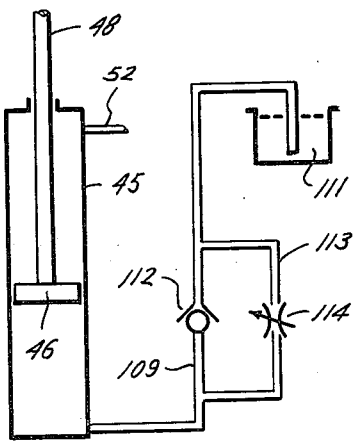
FIG. 5 is a diagrammatic view showing another fluid control circuit.

This other way is shown in FIG. 5. Whereas in the previous embodiments, the lower ends of the cylinders were provided with a port such as the port 45*a* which permits the cylinder to breathe as the piston moves upwardly and downwardly therein, in the apparatus of FIG. 5 the lower end of the cylinder is connected by way of conduit 109 to a tank or reservoir 111. The lower end of the cylinder is filled with liquid and when the piston moves downwardly in the cylinder the liquid is displaced to the tank, and when the piston moves upwardly in the cylinder liquid moves from the tank into the lower end of the cylinder. A check valve 112 is provided in the conduit 109 so that when the piston moves upwardly in the cylinder liquid may move freely from the tank into the cylinder but when the piston moves downwardly in the cylinder the check valve closes and the liquid must move through branch conduit 113 and the adjustable orifice 114 therein. This orifice 114 may be adjusted so that the descent of the piston in the cylinder may be controlled at a desired rate of speed. Thus, when the pipe is being run into the well, being forced downwardly thereinto by the energy stored in the accumulator or in the air tank, the brake system on the draw works will be saved by allowing the flow of oil through the orifice 114 to control the downward speed of the pipe into the well, and yet, when the traveling block is lifted, the piston may be moved freely upwardly as the liquid may move freely from the tank to the cylinder through the open check valve 112.

Either of the apparatuses shown in FIGS. 1 through 4 may be used without a conventional rig if hydraulic means are provided for lifting the piston in the cylinders rather than lifting them with the rig draw works as before described. Thus in FIG. 5, a motive force such as a motor 116 is connected to a pump 115 to drive the same to pick up hydraulic fluid from a tank 122 through the intake tube 117 and discharge it into the conduit 120 leading to a three-way valve 118 which is connected into the lower end of the cylinder below the piston 46. Valve 118 is provided with a drain tube 119 which empties into the tank 112 and is preferably provided with a restriction such as the adjustable restriction 121 for controlling the flow rate through the drain tube. Thus, the pump picks up fluid from the tank 122 and discharges it into the lower end of the cylinder below the piston when the three-way valve 118 is in the position shown to move the piston upwardly in the cylinder. This, of course, is done against the force of the energy stored in the accumulator of FIG. 1 or the air tank of FIG. 2. When it is desired to move the piston downwardly in the cylinder the three-way valve 118 is turned to its other operating position wherein it communicates the cylinder with the drain tube 119 so that fluid may bleed from the lower end of the cylinder below the piston through the valve 118 and the drain tube 119 to the tank 122. When it is again desired to move the piston upwardly, the three-way valve 118 is returned to the position shown in FIG. 6 permitting the pump to force fluid into the lower end of the cylinder below the piston 46 again as before described.

If desired, a check valve such as the check valve 123 may be provided in the conduit 120 between the pump 115 and the three-way valve 118 to prevent back flow of fluid toward the pump.

Figure 6:
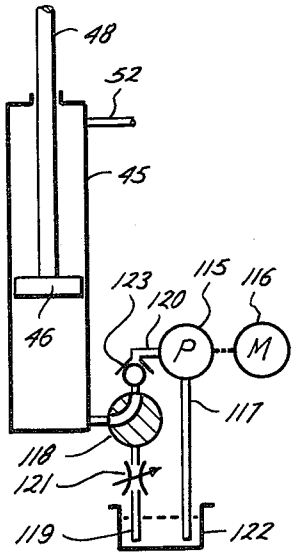
FIG. 6 is a diagrammatic view showing a fluid type motor substituted for the draw works of FIG. 1.

It will be readily appreciated that when a hydraulic system is connected to the cylinder 45 below the pistons 46 as is shown in FIGS. 5 and 6 that the liquid will lubricate the wall of the cylinder and reduce the friction between the cylinder and the piston. When the oil rather than air is used above the piston as in FIGS. 1, 3 and 4, lubrication of the cylinder should be no problem.

It will be readily seen that when compared to the conventional manner of snubbing pipe into a well under pressure that the procedure disclosed above provides a new and novel system for moving pipe into or out of a well.

It should be understood that in any of the hydraulic circuits and especially in those circuits where a restriction is used, that considerable heat may be generated especially if the fluid pressures are high and the differential pressures are great. In such cases, it may be desirable to provide means for dissipating such heat to cool the oil. Alternatively, larger volumes of oil may be used to prevent overheating of the oil.

Thus, it has been shown that the work done by a piston-cylinder arrangement may be accomplished quicker when such piston-cylinder assembly is operated in the manner disclosed hereinabove. It has further been shown that the movement of such piston can be controlled to an appreciable degree and that when such arrangement is used in snubbing pipe into or out of a well in conjunction with a conventional rig, the wear on the rig's brake system is minimized. Also, it has been shown that such apparatus makes it possible to operate a rig in a conventional manner in snubbing pipe into or out of a well and, therefore, minimizes the chance of accident as compared to the unconventional rig operation required when using some prior art snubbing apparatus.

The piston-cylinder arrangement disclosed hereinabove in which the piston is constantly biased in one direction by energy stored in an accumulator or tank and powered in the other direction by conventional fluid pressure means should be particularly suitable for use with a line multiplying arrangement such as that disclosed in U.S. Pat. No. 3,719,238 issued on Mar. 6, 1973 to John D. Campbell et al. The line multiplying arrangement in conjunction with the cylinder is capable of moving pipe handling or gripping means with great speed, thus further reducing wasted time and adding to the efficiency and effectiveness of the snubbing apparatus.

The foregoing disclosure and description of the invention are illustrative and explanatory thereof and various changes in the size, shape and materials, as well as in the details of the illustrated construction, may be made within the scope of the appended claims without departing from the spirit of the invention.

What is claimed is:

1. Snubbing apparatus comprising, movable means and holding means mounted for relative movement toward and away from each other, gripping means on each of said movable and holding means for selectively gripping a pipe, power means connected to the movable means for moving the movable means in one direction, accumulator means having a pressure charge therein, means for rendering said power means ineffective, and means connected to the movable means and providing for storing fluid under pressure in said accumulator means in response to movement of the movable means in said one direction and responsive to said fluid under pressure for moving the movable means in the other direction after said power means has been rendered ineffective.

2. The apparatus of claim 1 wherein power means are provided for operating said gripping means.

3. The apparatus of claim 1 wherein means are provided for selectively charging and venting said accumulator means with said pressure charge.

4. The apparatus of claim 1 wherein the power means is the draw works of a drilling rig with which the snubbing apparatus is associated.

5. The apparatus of claim 4 wherein movement of the movable means in response to pressure fluid in said accumulator is controlled by brakes associated with said draw works.

6. The apparatus of claim 1 wherein the apparatus is associated with a petroleum well and the force exerted by said fluid under pressure plus the force of gravity on the pipe is always greater than any force in the well pushing the pipe in an upward direction.

7. A drilling rig and snubbing apparatus comprising, moveable means and holding means mounted for relative movement toward and away from each other, gripping means on each of said movable and holding means for selectively gripping a pipe, power means connected to the movable means for moving the movable means in one direction, said power means provided by the drawworks of the drilling rig, means for rendering said power means ineffective, a source of gas under pressure, and means in fluid communication with said source and responsive to said gas under pressure for constantly applying force to and moving the movable means in the other direction after said power means has been rendered ineffective.

8. The apparatus of claim 7 wherein the source of gas is a pressure vessel and means are provided for selectively charging and venting said vessel.

9. The apparatus of claim 7 wherein movement of the movable means in response to pressure in said vessel is controlled by brakes associated with said draw works.

10. The apparatus of claim 7 wherein control means are provided for controlling the rate of movement of the movable means in at least one direction.

11. The apparatus of claim 7 wherein means are provided for controlling the rate of movement of the movable means in both directions.

12. A snubbing apparatus comprising;

movable means and holding means mounted for relative movement toward and away from each other, gripping means on each of said movable and holding means for selectively gripping a pipe, power means connected to the movable means for moving the movable means in one direction, means for rendering said power means ineffective, a source of gas under pressure, and means in fluid communication with said source and responsive to said gas under pressure for constantly applying force to and moving the movable means in the other direction after said power means has been rendered ineffective, said snubbing apparatus being associated with a petroleum well and the force exerted by said gas under pressure plus the force of gravity on the pipe always being greater than any force in the well pushing the pipe in an upward direction.

13. Snubbing apparatus comprising, movable means and holding means mounted for relative movement toward and away from each other, gripping means on each of said movable and holding means for selectively gripping a pipe, power means connected to the movable means for moving the movable means in one direction, means for rendering the power means ineffective, piston and cylinder means associated with said movable means, said piston means attached to said movable means, and accumulator means having a pressure charged fluid therein in fluid communication with said cylinder means constantly urging the movable means in the other direction.

14. The apparatus of claim 13 wherein control means are provided for controlling flow of said pressure charged fluid in at least one direction.

15. The apparatus of claim 13 wherein a variable valve controls flow of said pressure charged fluid in at least one direction and a bypass line having a check valve therein bypasses said variable valve and permits free flow in the other direction.

16. The apparatus of claim 13 wherein variable valve means controls flow of said pressure charged fluid in both directions, a pair of bypass lines bypass said valve means, check valves in said bypass lines permit flow only in opposite directions, and valve means are provided for switching flow between said two bypass lines.

17. The apparatus of claim 13 wherein the power means is a fluid source having a fluid connection with the cylinder on the other side of said piston from the movable means, and control means including variable valve means are provided regulating flow of fluid between said cylinder and fluid source.

18. The apparatus of claim 13 wherein a source of fluid is connected to the cylinder on the other side of said piston from the movable means and control means including a variable valve means are provided regulating flow between said cylinder and said source of fluid.

19. A subcombination snubbing apparatus comprising.

movable means and holding means mounted for relative movement toward and away from each other, gripping means on each of said movable means and holding means for selectively gripping a pipe, said movable means connectable to a power means for moving the movable means away from the holding means, piston and cylinder means associated with said movable means, said piston means attached to said movable means, and accumulator means having a pressure charged fluid therein in fluid communication with said piston and cylinder means constantly urging the movable means toward the holding means.

20. The subcombination of claim 19 wherein control means are provided for controlling the rate of movement of the movable means in at least one direction. l 21. The method of snubbing pipe with movable means and holding means, each provided with selective from means, and mounted for relative movement toward and away from each other comprising;

constantly maintaining a force on the movable means urging it toward the holding means;

alternately applying and removing a force which is greater than said constantly maintained force to the movable means urging it away from the holding means to reciprocate the movable means, and accumulating a portion of the applied force each time it is applied and exerting said portion on the movable means in a direction to urge it toward the holding means, said constantly maintained force and said accumulated force moving the movable means toward the holding means when said externally applied force is removed.

22. The method of claim 21 wherein the rate of movement of the movable means is controlled in at least one direction.

* * * * *

UNITED STATES PATENT AND TRADEMARK OFFICE

CERTIFICATE OF CORRECTION

PATENT NO. : 3,999,610

DATED : December 28, 1976

INVENTOR(S) : Vernon R. Sage and Phillip S. Sizer

It is certified that error appears in the above—identified patent and that said Letters Patent is hereby corrected as shown below:

Column 14, Line 37, change "from" to -- gripping --.

Signed and Sealed this

*Seventeenth* Day of *July 1984*

[SEAL]

*Attest:*

GERALD J. MOSSINGHOFF

*Attesting Officer*

*Commissioner of Patents and Trademarks*